US009810513B2

(12) United States Patent
Kerns et al.

(10) Patent No.: US 9,810,513 B2
(45) Date of Patent: Nov. 7, 2017

(54) MUNITION MODIFICATION KIT AND METHOD OF MODIFYING MUNITION

(71) Applicant: Raytheon Company, Waltham, MA (US)

(72) Inventors: Keith A Kerns, Tucson, AZ (US); Brandon Cundiff, Oro Valley, AZ (US); John J Spilotro, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 541 days.

(21) Appl. No.: 14/450,596

(22) Filed: Aug. 4, 2014

(65) Prior Publication Data

US 2016/0363426 A1 Dec. 15, 2016

(51) Int. Cl.

| | |
|---|---|
| ***F42B 33/00*** | (2006.01) |
| ***F42B 12/20*** | (2006.01) |
| ***F42B 12/32*** | (2006.01) |
| *F42B 10/64* | (2006.01) |
| *F42B 12/04* | (2006.01) |
| *F42B 25/00* | (2006.01) |

(52) U.S. Cl.
CPC ..... *F42B 33/001* (2013.01); *F42B 12/204* (2013.01); *F42B 12/32* (2013.01); *F42B 10/64* (2013.01); *F42B 12/04* (2013.01); *F42B 25/00* (2013.01)

(58) Field of Classification Search
CPC ..... F42B 12/04; F42B 12/204; F42B 12/22; F42B 12/32; F42B 33/001; F42B 10/64; F42B 25/00
USPC ..... 86/51, 53; 102/491, 494, 495, 496, 497, 102/506
See application file for complete search history.

(56) References Cited

U.S. PATENT DOCUMENTS 3,161,132 A * 12/1964 Siebert ..... F42B 12/80 102/374
3,601,055 A * 8/1971 Crockett ..... F42B 15/36 102/377

(Continued)

FOREIGN PATENT DOCUMENTS

DE 2557676 A1 6/1977
EP 1001244 A1 5/2000

(Continued)

*Primary Examiner* — Bret Hayes
(74) *Attorney, Agent, or Firm* — Renner, Otto, Boisselle & Sklar, LLP

(57) ABSTRACT

An existing munition may be modified, using a modification kit, to provide enhanced fragmentation effects. The munition may be enclosed in an airframe, which also contains pre-formed fragments, and one or more adapters may be used to provide connections through the airframe. The adapters may be used to substitute for types of connectors already on the existing munition. The adapters may include one or more of an adapter for coupling a tail kit to a tail of the munition, an adapter for coupling a nose kit to a nose of the munition, and an adapter for coupling lugs to the munition. The adapters may engage couplers on the munition, and/or may engage the airframe. The modification of the existing munition may transform the existing munition into a fragmentation weapon, for example usable for height-of-burst detonation to spread fragments over a large area.

20 Claims, 7 Drawing Sheets

(56) References Cited

U.S. PATENT DOCUMENTS

| | | | | |
|---|---|---|---|---|
| 3,699,891 | A * | 10/1972 | Kreuzer | F42B 15/00 102/374 |
| 3,981,243 | A | 9/1976 | Doris, Jr. | |
| 4,592,283 | A | 6/1986 | Hellner et al. | |
| 4,638,737 | A * | 1/1987 | McIngvale | F41H 5/007 102/476 |
| 4,648,323 | A | 3/1987 | Lawther | |
| 5,103,734 | A * | 4/1992 | Arnaud | F42B 12/62 102/293 |
| 5,117,759 | A | 6/1992 | Henderson et al. | |
| 5,131,329 | A | 7/1992 | Lips et al. | |
| 5,305,505 | A | 4/1994 | Ruhlman | |
| 5,535,679 | A | 7/1996 | Craddock | |
| 5,717,397 | A | 2/1998 | Ruszkowski | |
| 5,939,662 | A | 8/1999 | Bootes et al. | |
| 6,105,505 | A | 8/2000 | Jones | |
| 6,186,072 | B1 | 2/2001 | Hickerson, Jr. et al. | |
| 6,227,096 | B1 * | 5/2001 | Thomas | F42B 15/00 102/374 |
| 6,374,744 | B1 | 4/2002 | Schmacker et al. | |
| 6,484,642 | B1 | 11/2002 | Kuhns et al. | |
| 6,601,517 | B1 | 8/2003 | Guirguis | |
| 6,619,210 | B1 | 9/2003 | Spivak et al. | |
| 6,659,013 | B1 | 12/2003 | Kellner | |
| 7,261,042 | B1 * | 8/2007 | Brooks | F42B 12/06 102/521 |
| 7,530,315 | B2 * | 5/2009 | Tepera | F42B 12/60 102/351 |
| 7,614,348 | B2 | 11/2009 | Truitt et al. | |
| 8,061,275 | B1 | 11/2011 | Gold | |
| 8,069,790 | B1 * | 12/2011 | Melkers | F42B 15/01 102/275.9 |
| 8,191,479 | B2 | 6/2012 | Ruhlman et al. | |
| 8,234,979 | B1 | 8/2012 | Falabella et al. | |
| 8,671,840 | B2 | 3/2014 | Scheid et al. | |
| 8,701,557 | B2 | 4/2014 | Biggs et al. | |
| 2005/0115450 | A1 | 6/2005 | Lloyd | |
| 2010/0032515 | A1 | 2/2010 | Geswender et al. | |
| 2012/0017795 | A1 | 1/2012 | Dryer et al. | |
| 2012/0291651 | A1 | 11/2012 | Haumann et al. | |

FOREIGN PATENT DOCUMENTS

| | | | |
|---|---|---|---|
| EP | 1367358 | A2 | 12/2003 |
| FR | 2910612 | A1 | 6/2008 |
| GB | 2384291 | A | 7/2003 |
| WO | 9830863 | A1 | 7/1998 |
| WO | 023008 | A1 | 1/2002 |
| WO | 2008089078 | A2 | 7/2008 |
| WO | 2009102254 | A1 | 8/2009 |
| WO | 2011054361 | A1 | 5/2011 |
| WO | 2015175036 | A2 | 11/2015 |
| WO | 2015175037 | A2 | 11/2015 |
| WO | 2015175038 | A2 | 11/2015 |
| WO | 2015175039 | A2 | 11/2015 |
| WO | 2015175040 | A2 | 11/2015 |
| WO | 2016022181 | A1 | 2/2016 |
| WO | 2016022199 | A1 | 2/2016 |

* cited by examiner

MUNITION MODIFICATION KIT AND METHOD OF MODIFYING MUNITION

FIELD OF THE INVENTION

The invention relates to munitions, such as bombs or missiles.

DESCRIPTION OF THE RELATED ART

Large inventories of munitions exist, and some methods have been used to modify unguided "dumb" munitions to make them into "smart" munitions. An example is the PAVEWAY kit, produced by Raytheon Company, to modify munitions to provide laser guidance to unguided munitions.

SUMMARY OF THE INVENTION

A modification kit provides enhanced fragmentation capability to an existing munition by enclosing the existing munition in an airframe that includes preformed fragments. Adapters may be used to make connections between the existing munition and a nose kit, a tail kit, and/or a launch platform such as an aircraft.

According to an aspect of the invention, a modification kit for providing enhanced fragmentation capabilities to an existing munition, includes: an airframe; preformed fragments within the airframe; and one or more adapters to allow connection to the existing munition through the airframe.

The one or more adapters may include a tail adapter for coupling a tail kit to a tail of the munition.

The tail adapter may include lug clamps that engage a groove on a casing of the existing munition.

The lug clamps, when tightened against a flange of the casing, may provide an outward force that engages an inner surface of an aft connection of the airframe.

The one or more adapters may include a nose adapter for coupling a nose kit to a nose of the munition.

The nose adapter may be threaded into a nose connection of the existing munition.

The nose adapter may surround a conduit extension that connects to a forward conduit of the existing munition.

The one or more adapters may include lug adapters for coupling lugs to the munition.

The lug adapters each may include a male threaded end, and a female threaded receptacle end opposite the male threaded end.

The airframe may be a clamshell airframe that surrounds the existing munition.

The modification kit of any previous paragraph may be combined with the existing munition, to produce a modified munition.

The modified munition may include a nose kit coupled to a nose of the existing munition.

The nose kit may include canards for maneuvering the modified munition.

The nose kit may be operably coupled to a fuze of the existing munition, enabling triggering of the fuze by the nose kit, to detonate the modified munition.

The modified munition of may include a tail kit coupled to a tail of the existing munition.

The tail kit may include fins.

The existing munition may be a penetrator munition, and the modified munition is a fragmentation munition.

According to another aspect of the invention, a method of modifying an existing munition to produce a modified munition, includes the steps of: surrounding the existing munition with an airframe that contains preformed fragments within the airframe; and using one or more adapters to connect to the existing munition through the airframe.

The using the one or more adapters may include using a nose adapter to connect the existing munition to a nose kit that provides height-of-burst capability to the modified munition.

The existing munition may be a penetrator munition.

The surrounding the existing munition with the airframe may transform the penetrator munition into the modified munition that is capable of functioning as a fragmentation munition.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

An existing munition may be modified, using a modification kit, to provide enhanced fragmentation effects. The munition may be enclosed in an airframe, which also contains preformed fragments, and one or more adapters may be used to provide connections through the airframe. The adapters may be used to substitute for types of connectors already on the existing munition. The adapters may include one or more of an adapter for coupling a tail kit to a tail of the munition, an adapter for coupling a nose kit to a nose of the munition, and an adapter for coupling lugs to the munition. The adapters may engage couplers on the munition, and/or may engage the airframe. The airframe may be configured to correspond to the size, shape, weight, weight distribution, and/or profile of another type of munition, and may allow the modified munition to be coupled to an aircraft or other launch platform, and/or used, in a manner similar to another munition of that size, shape, weight, weight distribution, and/or profile. The modification of the existing munition may transform the existing munition into a fragmentation weapon, for example usable for height-of-burst detonation to spread fragments over a large area.

Figure 1:
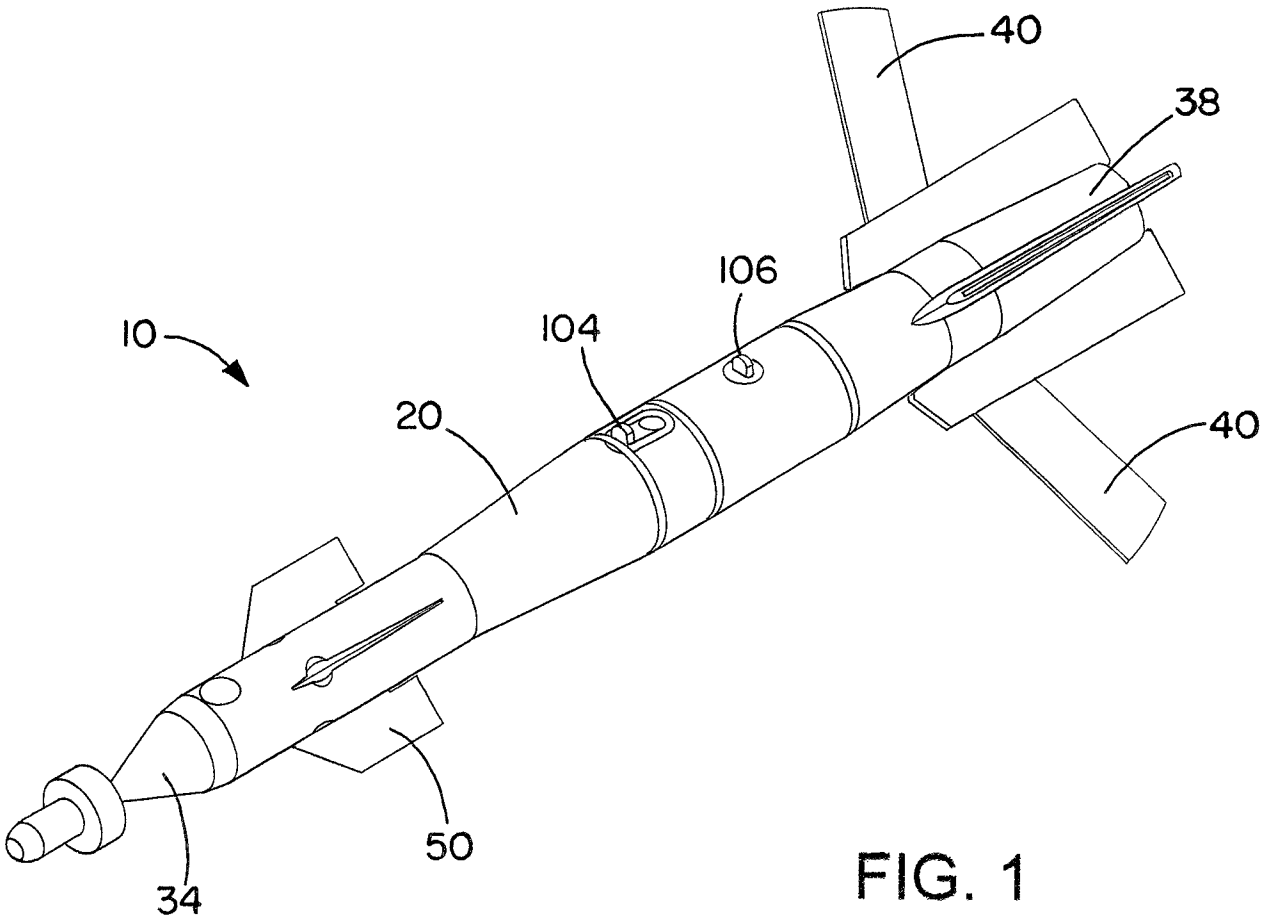
FIG. 1 is an oblique view of a modified munition in accordance with an embodiment of the present invention.
Figure 2:
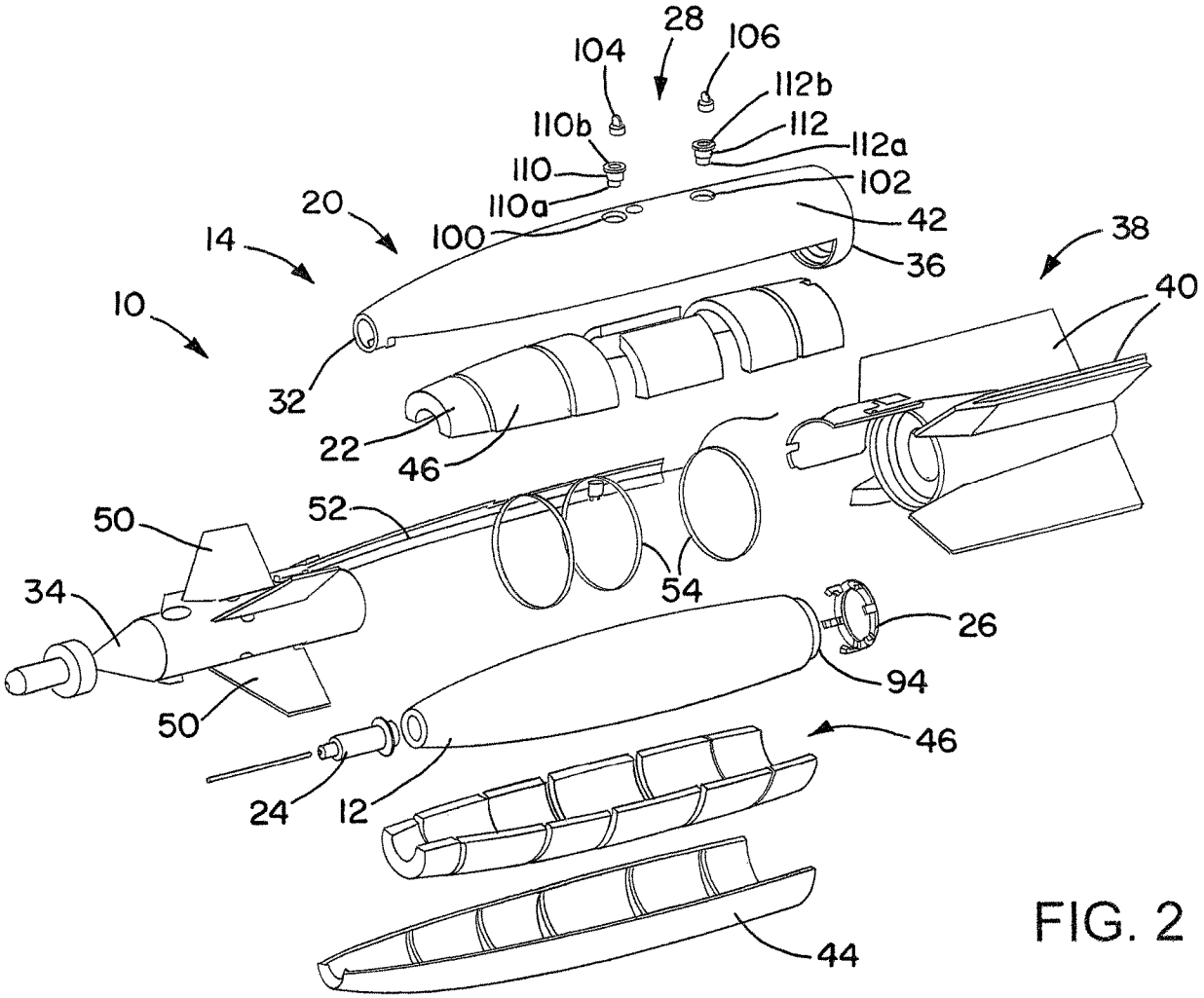
FIG. 2 is an exploded view of the munition of FIG. 1.

FIGS. 1 and 2 shows the parts of an enhanced munition 10 that includes an existing munition 12, modified to provide enhanced fragmentation capabilities by use of a modification kit 14. The modification kit 14 includes a clamshell airframe 20, preformed fragments 22 located within the airframe 20, and a series of adapters 24, 26, and 28. The adapters 24-28 are used for making connections through the airframe 20, to other parts of the enhanced munition 10. The clamshell airframe 20 includes a forward connection (bulkhead fitting) 32 for receiving a guidance nose kit 34 (for example), and an aft connection 36 for receiving (for example), a tail kit 38 with fins 40. The airframe 20 may be configured for using a standard weapons mount on a launch platform that is also able to receive other types of weapons. The connections 32 and 36 may be standard connections that are similar to those used for other munitions, thus enabling use of standard nose and tail kits that may be used with other sorts of munitions. The airframe 20 may be in the form of a pair of clamshell halves 42 and 44 that fit around the existing munition 12, and may be made of a relatively lightweight material, such as aluminum.

The existing munition 12 may be any of a variety of types of munitions, for example a bomb or missile. The existing munition 12 may be a penetrator munition, intended for detonation upon impact, and/or for penetrating a target.

The airframe 20 may be configured to correspond to the size, shape, weight, weight distribution, and/or profile of another type of munition, and may allow the modified munition 10 to be coupled to an aircraft (or other launch platform), and/or used, in a manner similar to another munition of that size, shape, weight, weight distribution, and/or profile. The illustrated embodiment shows one example configuration for the airframe 20. A wide variety of variations are possible, and the specific features of the illustrated embodiment (the clamshell halves 42 and 44, and the connections 32 and 36, for example) should not be considered as necessary essential features.

The preformed fragments 22 may fit into airframe 20, for example being mounted in packs 46, such as flexible bags, along the inner surfaces of the clamshell halves 42 and 44. The fragments 22 may include any of a variety of materials, such as steel, tungsten, aluminum, tantalum, lead, titanium, zirconium, copper, molybdenum, etc. The fragments 22 may be spheres, cubes, cylinders, flechetts, parallelepipeds, uncontrolled solidification shapes (such as used in HEVI-SHOT shotgun pellets), to give a few non-limiting examples. The fragments 22 may have any of a wide variety of suitable sizes. The fragments 22 may be in flexible bags, for example in plastic bags. The bags may also optionally include additional materials, for example such as metallic powder materials, such as aluminum, magnesium, zirconium, titanium or other reactive materials, for example providing incendiary or enhanced blast effects by being compacted in a suitable binder material. As an alternative to the use of the packs or bags, the fragments 22 may be molded into the shape(s) of one or more cavities in the airframe 20, for placement in the one or more cavities, using a frangible matrix bonding mix.

The guidance nose kit 34 may have canards 50 that are selectively moved to guide the enhanced munition 10 toward a desired target location. The nose kit 34 may include a processor or device for sending a signal to a fuze that is part of the existing munition 12, for detonating the enhanced munition 10. The nose kit 34 may include wiring 52 that is used to make communication with a launch platform, such as an aircraft, in order provide information on the target location, and/or other parameters for operation of the enhanced munition. The electrical connection with the launch platform may also be used to provide electrical power to the enhanced munition prior to launch. Batteries on the munition 10 (not shown) may provide power after separation form the aircraft or other launcher. A series of straps or hoops 54 may be used to hold the wiring 52 in place along the outside of the existing munition 12.

The fins 40 of the tail kit 38, which may be deployable, provide stability in flight to the enhanced munition 10. The nose kit 34 and the tail kit 38 may be parts of a standard enhancement for providing laser guidance capability for unguided munitions. Such enhancement for laser guidance is provided as part of PAVEWAY modified munitions, produced by Raytheon Company. Other types of nose kits and/or tail kits may be used in place of those in the illustrated embodiment.

The existing munition 12 may itself have suitable connections for coupling to the guidance nose kit 34, for coupling to the tail kit 38, and for making suitable connections (releasable mechanical and electrical connections) with the launch platform. However, the placement of the existing munition 12 in the airframe 20 leaves the existing munition 12 unable to use one or more of these connections. Hence the modification kit 14 includes the adapters 24, 26, and 28 for making connections through the airframe 20. Details regarding the adapters 24, 26, and 28 are discussed below.

Figure 3A:
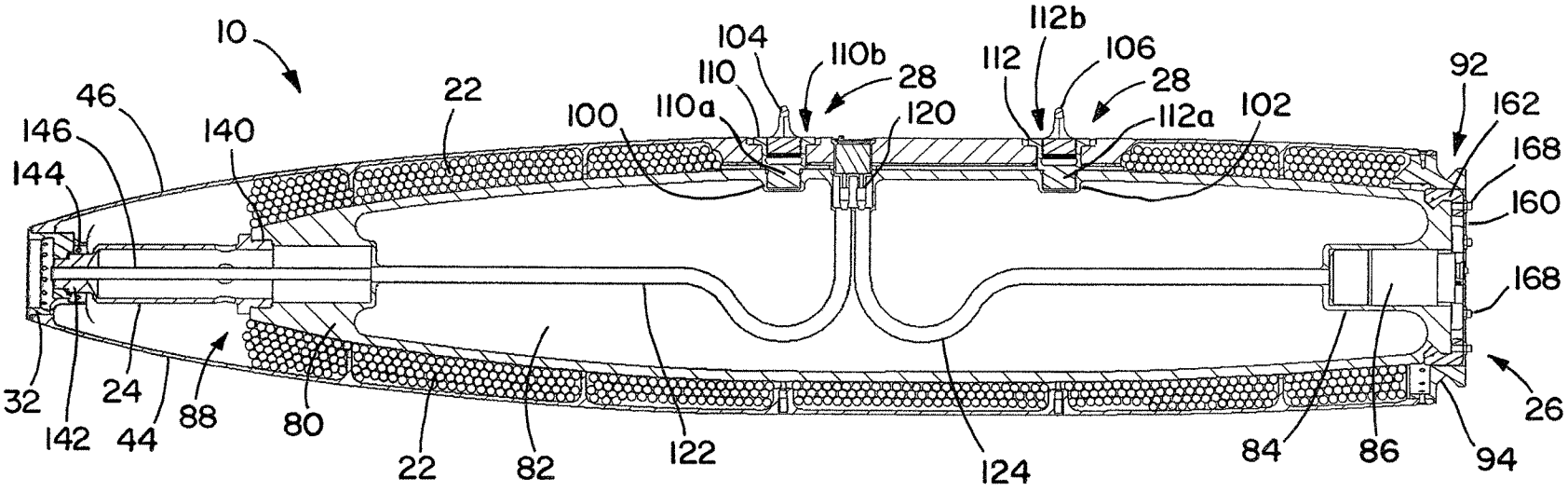
FIG. 3A is a side cross-sectional view of part of the modified munition of FIG. 1.

Referring now in addition to FIG. 3A, the existing munition 12 includes a casing 80 that encloses an explosive 82. The explosive 82 may be any of a variety of known explosive materials, such as high explosives. A fuzewell 84, at an aft end of the existing munition 12, houses a fuze 86 that is used for detonating the explosive 82. The casing 80 has a nose connection 88 for making connection to the nose adapter 24. The nose connection 88 may be a threaded hole at the forward end of the casing 80, which also may be capable of making a connection to the nose kit 34, in the absence of the airframe 20.

The casing 80 also has an aft end connection 92 for connecting to the tail adapter 26. The aft end connection 92 may be a groove 94 around the casing 80. The groove 94 may also be used for making a connection to the tail kit 38 (FIG. 2), in the absence of the airframe 20.

Further, the casing 80 has a pair of connections 100 and 102, for making connection both to lugs 104 and 106, for providing a connection to an aircraft (or other launcher), and to the lug adapter 28, which includes a pair of extensions 110 and 112 that engage the connections. The connections 100 and 102 may be threaded holes in the casing 80. The extensions 110 and 112 may have male threaded ends 110*a* and 112*a* that engage the threaded holes 100 and 102 in the casing 80. The extensions 110 and 112 also have female threaded receptacle ends 110*b* and 112*b*, opposite the male threaded ends 110*a* and 112*a*, for receiving the lugs 104 and 106. The lugs 104 and 106 are used in connecting to hooks or other release mechanisms on the launcher, for holding the munition 10 prior to launch. Essentially, the extensions 110 and 112 move the connection points off of the casing 80, allowing the lugs 104 and 106 to engage the munition 10, taking into account the presence of the airframe 20.

Figure 3B:
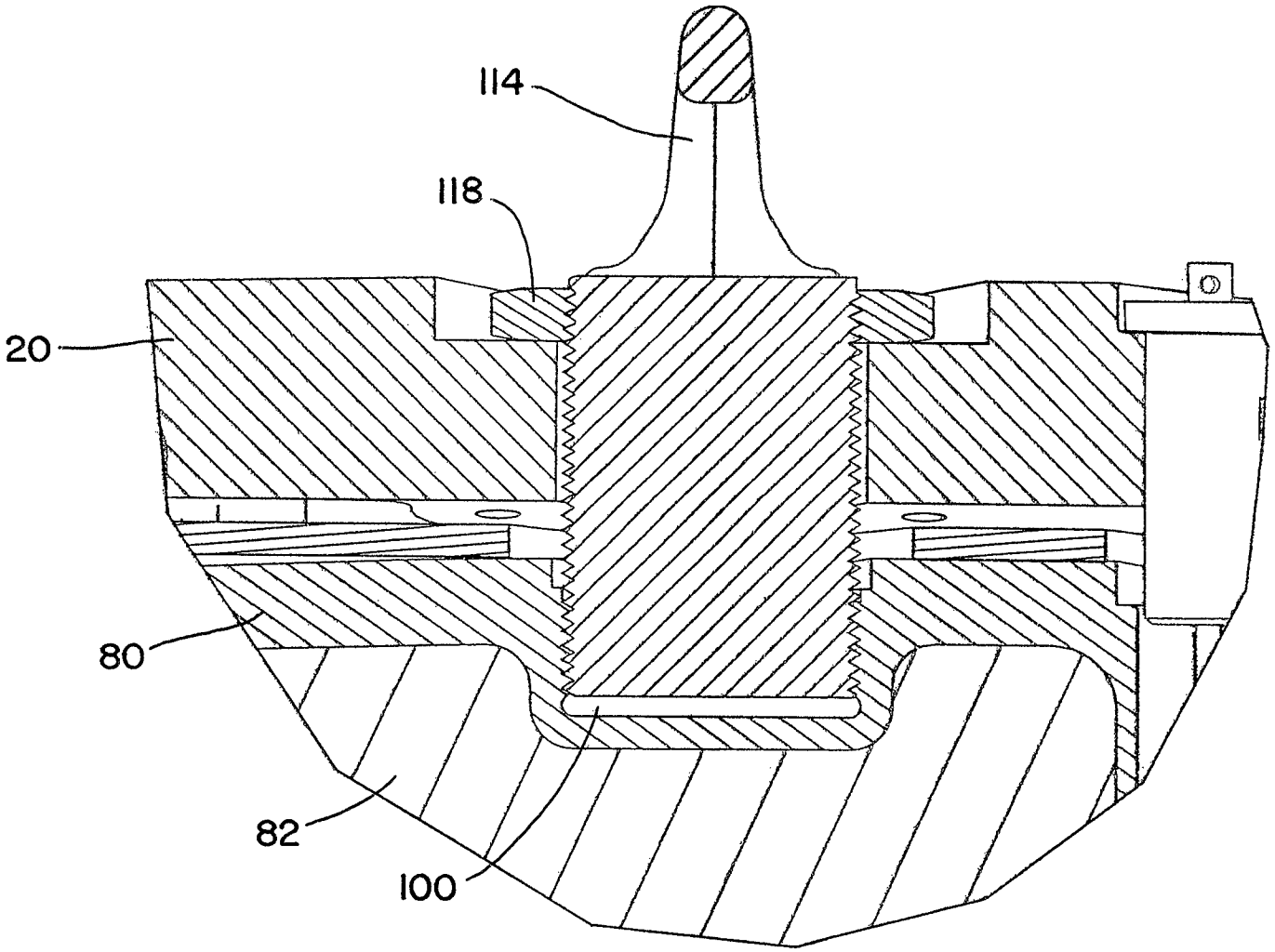
FIG. 3B is a side sectional view showing an alternative lug connection, usable with the munition of FIG. 1.

FIG. 3B shows an alternative configuration for connecting the munition 10 to an aircraft or other launcher. In the alternative configuration a pair of lugs, such as a lug 114, are used in place of both the lugs 104 and 106, and the extensions 110 and 112. The lugs, such as the lug 114, have threaded bodies that are long enough to pass through the airframe 20, and threadedly engage the threaded holes 100 and 102 in the casing 80 (only the threaded hole 100 is shown in FIG. 3B). The lugs may be held place by jam nuts, such as jam nut 118, to clamp the airframe 20 to the casing 80.

Returning now to FIG. 3A, the casing 80 has an electrical connection 120, between the connections 100 and 102, for making an electrical connection between the launcher and the munition 10. The electrical connection 120 may be used to provide pre-launch electrical power to components of the munition 10, to provide data (such as targeting data and burst height data) to the munition 10, and/or to provide data from the munition 10 to the launcher (such as data concerning functioning of the munition 10). The electrical connection 120 is coupled within the existing munition 12 to a pair of conduits, a forward conduit 122 and an aft conduit 124. The forward conduit 122 runs forward from electrical connection 120, toward the nose of the existing munition 12 and toward the nose kit 34. The aft conduit 124 runs rearward from the electrical connection, toward the tail kit 38. The conduits 122 and 124 allow for communication between the launcher and various parts of munition 10, and/or between various parts of the munition 10. For example, using the electrical connection 120 and the conduits 122 and 124, a signal may be sent from the nose kit 34 to trigger the fuze 86, to thereby detonate the explosive 82. Alternatively, at least some of the path for signals may be outside of the casing 80. For example the wiring 52 (FIG. 2) may travel outside of the casing 80, from the nose kit 34 to the electrical connector 120.

The nose adapter 24 has a threaded end 140 that threads into the nose connection 88. A forward end 142 of the nose adapter 24 engages the forward connection 32 of the airframe 20, a sleeve that also engages the nose kit 34 (FIG. 2). A saddle clamp 144 is used to secure the nose adapter 24 to the forward bulkhead fitting 32. A forward conduit extension 146 coupled to the forward conduit 122, and extends the conduit through the nose adapter 24 and to the nose kit 34.

Figure 4:
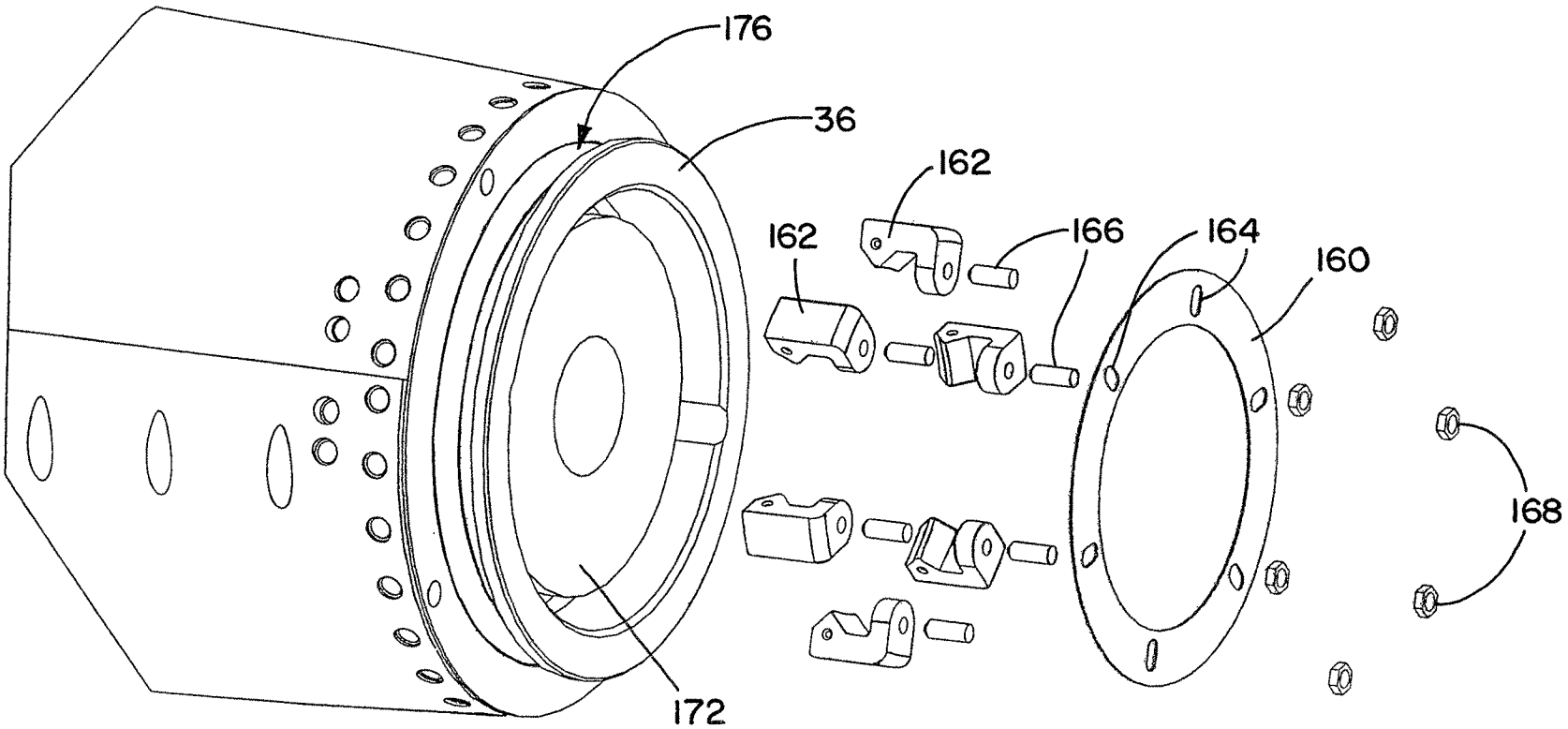
FIG. 4 is an exploded view of the aft end of part of the munition of FIG. 1, showing details of a tail adapter.
Figure 5:
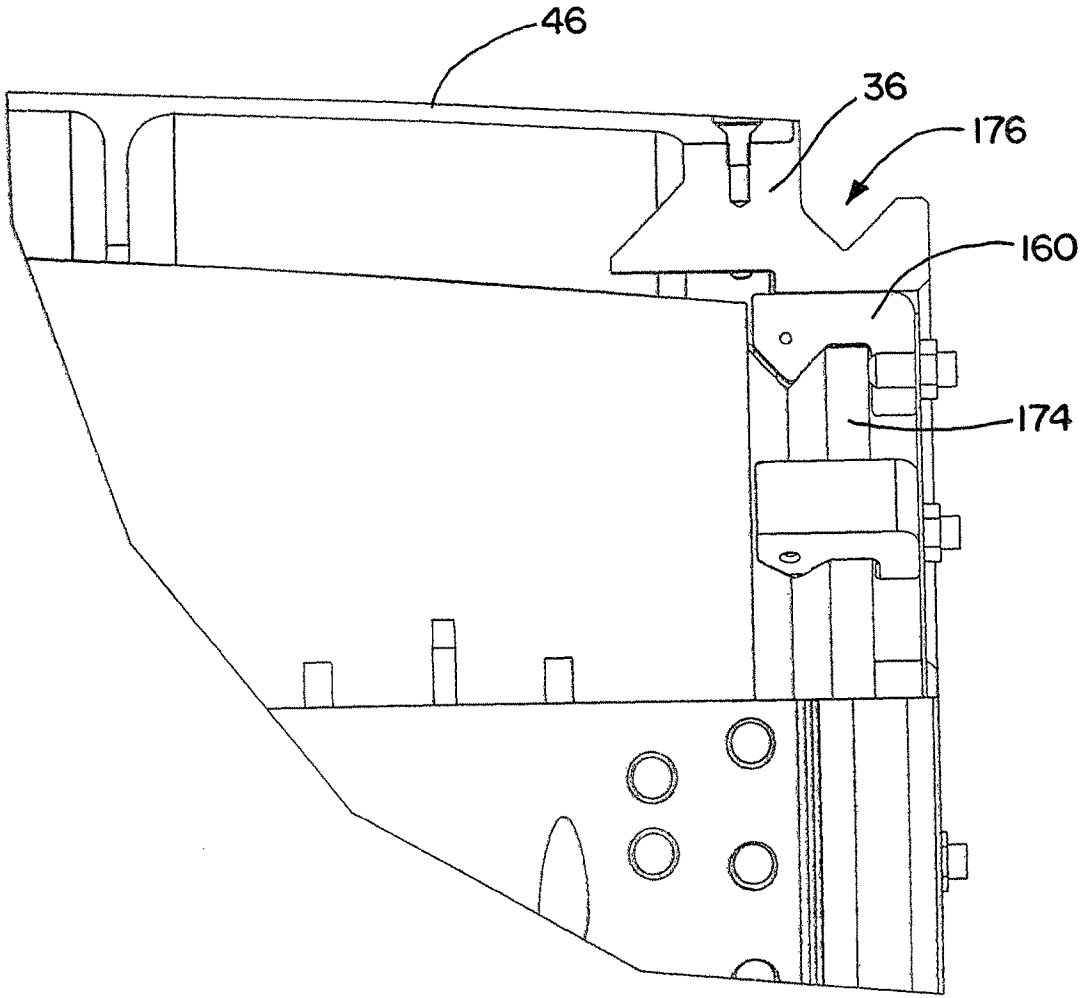
FIG. 5 is a partial cutaway view showing engagement between a tail adapter and the airframe of the munition of FIG. 1.

With reference in addition to FIGS. 4 and 5, the tail adapter 26 includes an index ring 160 and a set of lug clamps 162. The lug clamps 162 engage the groove 94 in the casing 80, with the index ring 160 maintaining the circumferential distribution of the lug clamps 162. The index ring 160 has holes 164 that allow lock jackscrews 166 to pass through, with the jackscrews 166 engaged by jam nuts 168 to hold the lug clamps 162 in place. The lug clamps 162 provide an outer surface for engaging the annular aft connection 36 of the airframe 20. As shown best in FIG. 5, tightening the screws 166 against a rear surface 172 of a flange 174 of the casing 80 causes the lug clamps 162 to exert a force outward against an inner surface of the aft connection 36, helping to hold the existing munition 12 in place within the airframe 20. The aft connection 36 has a groove 176 that the tail kit 38 engages.

The parts of the various adapters 24-28 may be made of suitable materials. Suitable materials include metals, such as steel or aluminum.

Many variations are possible for configuration of the various adapters 24-28. It will be recognized that different sorts of adapters may be used for different types of existing munitions and/or airframes.

Figure 6:
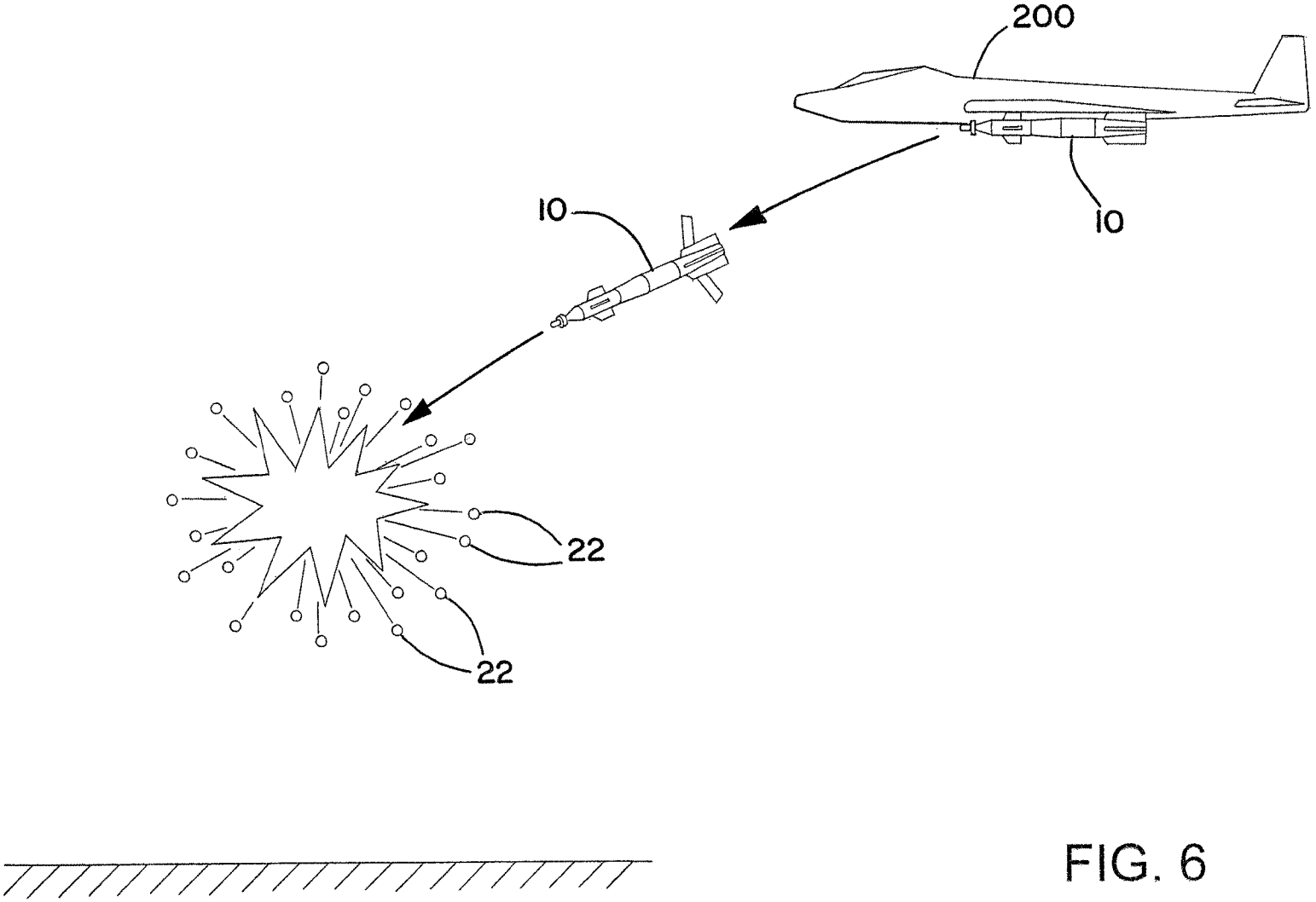
FIG. 6 is schematic view illustrating operation of the munition of FIG. 1.

FIG. 6 illustrates use of the munition 10 as a height-of-burst weapon. The munition 10 may be set to detonate the explosive 82 (FIG. 3A) at a predetermined height above the ground, to spray fragments over a large area, for example for use as an antipersonnel weapon. The height at which the munition 10 detonates may be set before launch of the munition 10, for example by communication from the launcher (an aircraft 200) to the munition 10 (e.g., the nose kit 34) through the electrical connection 120 (FIG. 3A). One or more sensors in the munition 10 may be used to determine the height of the munition 10 above the ground after launch. When the desired height is reached, a signal is sent, for instance from the nose kit 34, to trigger the fuze 86 (FIG. 3A) to detonate the explosive 82. This detonation can spread the fragments 22 over a large area. The munition 10 functions with a single detonation, initiated by triggering the fuze 86, in contrast to cluster munitions which have multiple detonations triggered separately at different times and/or in different locations.

The munition 10 described above advantageously transforms the existing munition 12, which may be a penetration munition, into a fragmentation munition (or a munition having enhanced fragmentation characteristics), through use of the modification kit 14. The transformation is such that the modification till allows use of the same guidance kit, tail fin kit, and connections to a launcher (e.g., the lugs) that are used in the existing munition.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A modification kit for providing enhanced fragmentation capabilities to an existing munition, the kit comprising:
- an airframe;
- preformed fragments within the airframe; and
- one or more adapters to allow connection to an existing munition through openings in the airframe;
- wherein the fragments are located outside of and surrounding a space within the airframe for receiving the existing munition.

2. The modification kit of claim 1, wherein the one or more adapters include a tail adapter for coupling a tail kit to a tail of the munition.

3. The modification kit of claim 1, wherein the one or more adapters include a nose adapter for coupling a nose kit to a nose of the munition.

4. The modification kit of claim 3, wherein the nose adapter is threaded into a nose connection of the existing munition.

5. The modification kit of claim 1, wherein the one or more adapters include lug adapters for coupling lugs to the munition.

6. The modification kit of claim 1, wherein the airframe is a clamshell airframe that surrounds the existing munition.

7. The modification kit of claim 1, in combination with the existing munition, thereby producing a modified munition.

8. The modified munition of claim 7, further comprising a nose kit coupled to a nose of the existing munition.

9. The modified munition of claim 8, wherein the nose kit includes canards for maneuvering the modified munition.

10. The modified munition of claim 7, further comprising a tail kit coupled to a tail of the existing munition.

11. The modified munition of claim 10, wherein the tail kit includes fins.

12. The modified munition of claim 7, wherein the existing munition is a penetrator munition, and the modified munition is a fragmentation munition.

13. The modification kit of claim 1, wherein the fragments are located in packs along inner surfaces of the airframe.

14. The modification kit of claim 13, wherein the fragments are in flexible bags.

15. The modification kit of claim 13, wherein the fragments are in molded packs, with the fragments held together using a frangible matrix bonding mix.

16. A modification kit for providing enhanced fragmentation capabilities to an existing munition, the kit comprising:

an airframe;

preformed fragments within the airframe; and one or more adapters to allow connection to an existing munition through the airframe;

wherein the one or more adapters include a tail adapter for coupling a tail kit to a tail of the munition; and wherein the tail adapter includes lug clamps that engage a groove on a casing of the existing munition.

17. The modification kit of claim 16, wherein the lug clamps, when tightened against a flange of the casing, provide an outward force that engages an inner surface of an aft connection of the airframe.

18. A modification kit for providing enhanced fragmentation capabilities to an existing munition, the kit comprising:

an airframe;

preformed fragments within the airframe; and one or more adapters to allow connection to an existing munition through the airframe;

wherein the one or more adapters include a nose adapter for coupling a nose kit to a nose of the munition;

wherein the nose adapter is threaded into a nose connection of the existing munition; and wherein the nose adapter surrounds a conduit extension that connects to a forward conduit of the existing munition.

19. A modification kit for providing enhanced fragmentation capabilities to an existing munition, the kit comprising:

an airframe;

preformed fragments within the airframe; and one or more adapters to allow connection to an existing munition through the airframe;

wherein the one or more adapters include lug adapters for coupling lugs to the munition; and wherein the lug adapters each include a male threaded end, and a female threaded receptacle end opposite the male threaded end.

20. A modification kit for providing enhanced fragmentation capabilities to an existing munition, the kit comprising:

an airframe;

preformed fragments within the airframe; and one or more adapters to allow connection to an existing munition through the airframe;

in combination with the existing munition, thereby producing a modified munition;

further comprising a nose kit coupled to a nose of the existing munition;

wherein the nose kit includes canards for maneuvering the modified munition; and wherein the nose kit is operably coupled to a fuze of the existing munition, enabling triggering of the fuze by the nose kit, to detonate the modified munition.

* * * * *